United States Patent [19]

Corti et al.

[11] 4,228,670

[45] Oct. 21, 1980

[54] PROCESS FOR THE ISOTHERMAL FORGING OF A WORK PIECE

[75] Inventors: Christopher W. Corti, Reading, England; Rolf Lüthi, Fislisbach; Ernst Vogt, Remigen, both of Switzerland

[73] Assignee: BBC Brown, Boveri & Company, Limited, Baden, Switzerland

[21] Appl. No.: 954,735

[22] Filed: Oct. 26, 1978

[30] Foreign Application Priority Data

Oct. 26, 1977 [CH] Switzerland ..... 13050/77

[51] Int. Cl.[2] ..... B21J 3/00

[52] U.S. Cl. ..... 72/42; 72/43; 72/53

[58] Field of Search ..... 72/53, 41, 42, 43

[56] References Cited

U.S. PATENT DOCUMENTS

| | | | |
|---|---|---|---|
| 3,574,658 | 4/1971 | Fulk et al. | 72/53 |
| 3,754,976 | 8/1973 | Babecki et al. | 72/53 |

*Primary Examiner*—Lowell A. Larson

*Attorney, Agent, or Firm*—Oblon, Fisher, Spivak, McClelland & Maier

[57] ABSTRACT

A process for the lubrication of a tool surface which comprises high pressure blast spraying a powder lubricant having a particle size of 0.6 to 1.5 $\mu$ at a spray pressure of 4 to 5 bar, onto the tool surface thereby producing a high temperature compacted coherent lubricant film on the surface while simultaneously smoothing, strengthening and compressively stressing the tool surface.

13 Claims, No Drawings

PROCESS FOR THE ISOTHERMAL FORGING OF A WORK PIECE

BACKGROUND OF THE INVENTION

1. Field of the Invention

This invention is concerned with a process for the lubrication of tool surfaces, such as die surfaces, by producing on the tool a film of a high-temperature lubricant.

2. Description of the Prior Art

Graphite containing lubricants are for example known in metal extrusion. At very high temperatures and lengthy deformation process, such as for example in isothermal die forging, such lubricants fail in general, as completely water free graphite has insufficient antifriction properties. Moreover, there is a tendency for a chemical reaction with the material of the die (especially molybdenum based alloys such as TZM) or workpiece. Such a carbon pick-up is however completely undesirable from the point of view of the material properties. Since the workpiece and tool have practically the same temperatures during isothermal high temperature forming operations, the tendency for mutual galling increases and further stricter requirements are placed on the lubricants used, than is the case in conventional extrusion, hot drawing and forging. Consequently lubricants based on oils, soaps, graphite or molybdenum sulphide are unsuitable for the present purposes. It has been attempted to produce a lubricant film on the surface of the tool or that of the piece to be deformed, using boron nitride, mixtures of it with boric acid and graphite and glassy material. These materials are mostly used as suspensions or pastes in organic solvents such as alcohol or toluene or as suspensions in other liquids. The coating of the metal piece with the lubricant is thereby achieved by dipping, smearing or spraying and is followed by a drying process at room temperature or a baking at a higher temperature. Such lubricants and processes are known from several publications. (e.g. T. Watnough, "Development of isothermal forging of titanium centrifugal compressor impeller", AMMRC Report CTR 73 - 19, IIT Research Institute Chicago, May 1973, p.16; U.S. Pat. No. 3,635,068; "Isothermal forging of precision metal powder components", Report AD-780 044, published by NTIS, National Technical Information Service, U.S. Department of Commerce, December 1973, p. 27, 41, 43) The known lubricants and lubricant combinations as well as the corresponding processes using the lubricants are unsatisfactory with respect to the requirements of temperature and pressure resistance, chemical inactivity with respect to the metal surface to be protected and to be lubricated, as well as lubricating power and optimum viscosity. This is apparent from the above mentioned publications (Report AD 780-044 of the NTIS, p. 43, 50, 54, 58; also D. J. Abson, F. J. Gurney, "Heated dies for forging and friction studies on a modified hydraulic forge press", Metals and Materials, December 1973, p. 539).

Furthermore the known processes for producing a lubricating film on the metal surface of interest by dipping, spraying, baking etc. are complicated, expensive and time-consuming. The active component of conventional lubricants, suspended in a liquid, must be applied wet on to the tool. Drying-out or evaporation of the liquid medium must be prevented. If on the other hand the lubricant, eg. boron nitride, is applied in solid form by conventional spraying of a powder, then its adhersion to the metal surface leaves something to be desired. Moreover thick coherent coatings can be made by these conventional methods only with difficulty. Hence there is a definite need for new methods for the production of lubricant films on metallic tools which are continuously exposed to high temperatures. In particular there is a requirement for simple ways and means of providing a coherent lubricant protecting layer on tools whose surface has been roughened by a previous machining operation (turning, milling, planing grinding, polishing, eroding, electrochemical machining etc.) and contains pores.

SUMMARY OF THE INVENTION

Accordingly one object of the invention is to provide a simple and economic process for the production of a durable and firmly adhesive lubricant film on the metallic surface of a high temperature tool, whereby the roughness of the tool surface is simultaneously reduced, the pores closed and the zone lying immediately under the surface of the tool is further compacted; cold worked and put into a state of compressive stress. The process guarantees a high wear resistance, good lubricating properties and an optimum viscosity of the applied lubricant film at the service temperature, and is particularly advantageous for new, freshly machined clean tool surfaces. Briefly, these and other objects of the invention as will hereinafter become more readily apparent can be attained by providing a process wherein the lubricant is blasted in the form of powder of particle size of 0.6 to 1.5$\mu$ as a component in the spray of a sand blasting apparatus.

DETAILED DESCRIPTION OF THE PREFERRED EMBODIMENTS

According to the present invention, a highly satisfactory lubrication for the work pieces used in high temperature isothermal forging has been achieved by spraying the lubricant on the work piece by means of a high pressure spray apparatus. High speeds corresponding to a gas pressure of 4 to 5 bar are used and the lubricant is compacted to a coherent coating. Simultaneously the tool surface is smoothed, hardened and put under compressive stress by the accelerated lubricant particles. The process is applied particularly advantageously in the warm working by pressing or forging, in particular the isothermal forging of titanium alloys, using a tool of a molybdenum alloy (TZM).

The process is particularly advantageous for new, unused tools with freshly machined and otherwise untreated surfaces. Among these come above all forging dies for the isothermal forging of alloys with increased hot strength.

EXAMPLE

A further understanding of this invention can be obtained by reference to the following example which is provided herein for purposes of illustration only and is not intended to be limiting unless otherwise specified. A newly machined die of a molybdenum alloy of the type TZM (e.g. 0,5% Ti, 0,08% Zr, 0,02% C balance Mo) intended for the isothermal forging of titanium alloys (eg Ti6A14V) was inserted in a shot peening apparatus. However, in place of the quarz or sand normally used, the equipment was charged with boron nitride powder of particle size of 0,6$\mu$ to 1,5$\mu$ and the die surface subjected to a BN spray under a gas pressure of 4 to 5 atmospheres. A threefold effect was thereby achieved. Firstly, the metal surface of the die which showed a certain roughness from the machining (turning, milling, planing, grinding, polishing, eroding, electrochemical machining etc.), was smoothed. Secondly the impact of the high speed BN- particles arriving at the metal surface resulted in its compaction and cold working, whereby additionally a compression stress, favourable for the mechanical service behaviour, was created. Thirdly the BN particles partially penetrated into the metal surface and formed a well adhering, coherent, thin boron nitride layer, which possesses excellent high-temperature lubricating properties. After this treatment the die had a BN layer of average thickness 0,5$\mu$ to 1$\mu$. other embodiments of the invention are as follows A mixture of boron nitride (BN) with boron oxide ($B_2O_3$) or boric acid ($H_3BO_3$) can also be used in place of pure boron nitride. The process can likewise be used with the addition to the boron nitride of substances such as borosilicon glass or borax, which form a glass-like layer at the service temperature. Depending on the specific application, the mixture can contain 5 to 95 weight percent of the previously mentioned second component, balance boron nitride. The borosilicate glass has preferably the following composition.

8–10 wt % $SiO_2$
2–14 wt % $Na_2O$
max. 4 wt % CaO
30–90 wt % $B_2O_3$
max. 2 wt % $Al_2O_3$ Furthermore, one can also spray a mixture of BN, BN+$B_2O_3$ etc which contains a variable percent of spherical glass or sand particles. The content of the latter can thereby be between 1 and 99 wt % of the total mixture and they could have a diameter of 0,2 to 1$\mu$ depending on the material to be deformed. An addition of glass particles of 0.3$\mu$ or steel particles of 0,4 to 0,6$\mu$ diameter is suitable for the isothermal forging of titanium alloys (eg. Ti6A14V). By the addition of glass or steel particles to the spray, the boron nitride powder (or the mixture BN+$B_2O_3$, BN+$H_3BO_3$ etc) is better hammered into the tool surface and the latter is put under a higher compressive stress. Using the method described above, particularly highly adhesive coatings can be produced, whereby additionally the viscosity at the service temperature can be varied within broad limits by changing the ratio of boron nitride to glass-like additives. The viscosity can be selected for any given application. Through the process according to the invention for the creation of lubricant films on high temperature tools, a method was described which allows simultaneously the improvement of the surface quality and the production of a firmly adhesive lubricant film. The method, especially advantageous for forging dies, is above all suitable for freshly machined, new tools, which are going into service for the first time. Having now fully described this invention, it will be apparent to one of ordinary skill in the art that many changes and modifications can be made thereto without departing from the spirit or scope of the invention set forth herein.

What is claimed as new and intended to be covered by letters patent is:

1. A process for the lubrication of a tool surface which comprises:

high pressure blast spraying a powder lubricant comprising boron nitrite having a particle size of 0.6 to 1.5$\mu$ at a spray pressure of 4 to 5 bar, onto said tool surface thereby producing a high temperature compacted coherent lubricant film on said surface while simultaneously smoothing, strengthening and compressively stressing said tool surface.

2. The process of claim 1 wherein said high-pressure blast spraying is effected using a sand blasting machine.

3. The process of claim 1 wherein said lubricant in powder form consists essentially of boron nitride powder.

4. The process of claim 1 wherein said lubricant in powder form is a mixture of 95 wt.% to 5 wt.% boron nitride and 5 wt.% to 95 wt.% boric acid powder.

5. The process of claim 1 wherein said lubricant in powder form is a mixture of 95 to 5 wt.% boron nitride and 5 to 95 wt.% borosilicate glass.

6. The process of claim 5 wherein said borosilicate glass has the composition:

8–60 wt.% $SiO_2$
2–14 wt.% $Na_2O$
max. 4 wt.% CaO
30–90 Wt.% $B_2O_3$
max. 2 wt.% $Al_2O_3$

7. The process of claim 1 wherein said lubricant is a mixture of 95 to 5 wt.% boron nitride and 5 to 95 wt.% borax powders.

8. The process of claim 1 wherein said lubricant comprises spherical glass or steel particles or mixtures thereof with a diameter of 0.2 to 1$\mu$.

9. The process of claim 8 wherein said glass particles have a diameter of 0.3$\mu$ and said steel particles have a diameter of 0.4 to 0.6$\mu$ and wherein the proportion of said glass or said steel particles or mixtures thereof in the total powder mixture is 1 to 99 Wt.%.

10. The process according to claim 1 wherein the material of said tool is a molybdenum alloy.

11. The process of claim 1 wherein said tool is a forging die.

12. The lubricated tool obtained by the process of claim 1.

13. The lubricated forging die obtained by the process of claim 11.

* * * * *